US012234564B2

(12) United States Patent
Hao et al.

(10) Patent No.: US 12,234,564 B2
(45) Date of Patent: Feb. 25, 2025

(54) PREPARATION METHOD AND APPLICATION OF THREE-DIMENSIONAL STRUCTURED ELECTRIC CATHODE BASED ON CUPROUS OXIDE

(71) Applicant: NORTH CHINA ELECTRIC POWER UNIVERSITY (BAODING), Baoding (CN)

(72) Inventors: Runlong Hao, Baoding (CN); Yunchang Song, Baoding (CN); Longlong Yang, Baoding (CN); Qinlin Tian, Baoding (CN)

(73) Assignee: NORTH CHINA ELECTRIC POWER UNIVERSITY (BAODING), Baoding (CN)

( * ) Notice: Subject to any disclaimer, the term of this patent is extended or adjusted under 35 U.S.C. 154(b) by 0 days.

(21) Appl. No.: 18/346,956

(22) Filed: Jul. 5, 2023

(65) Prior Publication Data

US 2024/0410066 A1 Dec. 12, 2024

(30) Foreign Application Priority Data

Jun. 9, 2023 (CN) ..... 202310679492.0

(51) Int. Cl.
*C25D 3/38* (2006.01)
*C25B 1/27* (2021.01)
(Continued)

(52) U.S. Cl.
CPC ..... *C25B 11/077* (2021.01); *C25B 1/27* (2021.01); *C25B 11/031* (2021.01); *C25B 11/061* (2021.01); *C25D 9/08* (2013.01)

(58) Field of Classification Search
CPC ..... C25D 3/38; C25D 5/34; C25B 1/27
(Continued)

(56) References Cited

FOREIGN PATENT DOCUMENTS

CN 105731518 A 7/2016
CN 112408555 A * 2/2021 ..... C02F 1/46109
(Continued)

OTHER PUBLICATIONS

Du et al., "Preparation and Characterization of Cu2O Thin Films by Electrodeposition in Acidic Media," Integrated Ferroelectrics (Oct. 1, 20223), vol. 229, No. 1, pp. 295-304. (Year: 2022).*
(Continued)

*Primary Examiner* — Edna Wong
(74) *Attorney, Agent, or Firm* — Pilloff Passino & Cosenza LLP; Rachel Pilloff; Sean Passino

(57) ABSTRACT

A preparation method and an application of a three-dimensional structured electric cathode based on cuprous oxide are provided by the present application. The preparation method includes the following steps: cutting copper foam, sequentially subjecting to ultrasonic treatment with acetone, hydrochloric acid, anhydrous ethanol and deionized water, followed by washing and vacuum drying to serve as an electrode substrate for later use; dissolving sodium acetate and copper acetate in deionized water, fully stirring for completely dissolution to obtain a solution, and adjusting a pH value of the solution to be acidic to serve as an electrodeposition precursor solution; and placing the copper foam in the electrodeposition precursor solution, electrodepositing at a predetermined temperature by using a three-electrode system and a potentiostatic method, followed by taking out, washing, and drying to obtain a catalytic electrode. The electric cathode is applied in fields of electrocatalytic reduction of nitrate and electrocatalytic ammonia production.

4 Claims, 6 Drawing Sheets

(51) Int. Cl.

| | |
|---|---|
| ***C25B 11/031*** | (2021.01) |
| ***C25B 11/061*** | (2021.01) |
| ***C25B 11/077*** | (2021.01) |
| ***C25D 5/34*** | (2006.01) |
| ***C25D 9/08*** | (2006.01) |

(58) Field of Classification Search
USPC ..... 205/210, 211, 215, 296, 333, 552
See application file for complete search history.

(56) References Cited

FOREIGN PATENT DOCUMENTS

| | | | | |
|---|---|---|---|---|
| CN | 113968602 A | | 1/2022 | |
| CN | 115010217 A | * | 9/2022 | ..... C02F 1/46109 |

OTHER PUBLICATIONS

Niu et al., "Anneal-Shrinked Cu2O Dendrites Grown on Porous Cu Foam as a Robust Interface for High-Performance Nonenzymatic Glucose Sensing," Talanta (Dec. 1, 2016), vol. 161, pp. 615-622. (Year: 2016).*

El-Shaer et al., "Fabrication of Homojunction Cuprous Oxide Solar Cell by Electrodeposition Method," Nat. Sci. (2015), vol. 13, No. 5, pp. 14-22. (Year: 2015).*

Kalubowila et al., "Effect of Bath pH on Electronic and Morphological Properties of Electrodeposited Cu2O Thin Films," Journal of the Electrochemical Society (Feb. 22, 2019), vol. 166, No. 4, pp. D113-D119. (Year: 2019).*

Chen et al., "Cu2O Nanoparticles Modified BiO2-x Nanosheets for Efficient Electrochemical Reduction of Nitrate-N and Nitrobenzene From Wastewater," Separation and Purification Technology (May 15, 2022), vol. 289, pp. 1-9. (Year: 2022).*

Xu et al., "Interface Coupling Induced Built-In Electric Fields Boost Electrochemical Nitrate Reduction to Ammonia Over CuO@ MnO2 Core-Shell Hierarchical Nanoarrays," Journal of Materials Chemistry A. (2022), vol. 10, No. 32, 16883-16890. (Year: 2022).*

Du et al., "Preparation and Characterization of Cu2O Thin Films by Electrodeposition in Acidic Media," Integrated Ferroelectrics (Oct. 13, 2022), vol. 229, No. 1, pp. 295-304. (Year: 2022).*

Yan et al., "Fabrication of Snowflake-Like CuO Nanostructure via Electrodeposition Method and Its Properties," Journal of Materials Science: Materials in Electronics (Apr. 2016), vol. 27, pp. 4035-4042. (Year: 2016).*

Zhou et al., "Achieving Efficient and Stable Electrochemical Nitrate Removal by In-Situ Reconstruction of Cu2O/Cu Electroactive Nanocatalysts on Cu Foam," Applied Catalysis B: Environmental (Nov. 15, 2022), vol. 317, pp. 1-14. (Year: 2022).*

Sun Fang, "Electrodeposition preparation and properties of copper and cuprous oxide films," Metallurgical industry press, Jan. 31, 2019, p. 134 Related claims: 1-8.

Yang Peixia et al., "The Monograph of Modern Electrochemical Surface Treatment," Harbin institute of technology press, Oct. 31, 2016, pp. 247-248. Related claims: 1-5.

First Office Action for China Application No. 202310679492.0, mailed Nov. 20, 2023.

Second Office Action for China Application No. 202310679492.0, mailed Dec. 25, 2023.

* cited by examiner

PREPARATION METHOD AND APPLICATION OF THREE-DIMENSIONAL STRUCTURED ELECTRIC CATHODE BASED ON CUPROUS OXIDE

CROSS-REFERENCE TO RELATED APPLICATIONS

This application claims priority to Chinese Patent Application No. 202310679492.0, filed on Jun. 9, 2023, the contents of which are hereby incorporated by reference.

TECHNICAL FIELD

The present application belongs to the technical field of environmental functional materials, and particularly relates to a preparation method and an application of a three-dimensional structured electric cathode based on cuprous oxide.

BACKGROUND

In recent years, hydrogen energy has been developed rapidly and become an important part of the energy policies of many countries. However, the existing technology of hydrogen storage and transportation is relatively backward, and it is pressing to develop advanced and safe methods of storing and transporting hydrogen energy. Among them, "ammonia-hydrogen", as one of the chemical hydrogen storage technology routes, has a good prospect of development thanks to the advantages of low transportation difficulty and high hydrogen storage density, and thus becomes a key part of the layout of "ammonia economy" in many countries, and has been given a new significance under the concept of "carbon neutrality". Moreover, ammonia is widely used as a nitrogen-hydrogen compound in fertilizer and pharmaceutical industries, and is one of the most produced inorganic compounds in the world. However, the prevailing process for synthesizing ammonia nowadays is the Haber-Bosch process with high energy consumption and low energy efficiency, not a desired process technology at present, so it is imperative to develop an efficient ammonia process with low consumption.

Nitrate is a common pollutant that exists to varying degrees in groundwater in urban and rural areas as a result of the development of industrial and agricultural production, and is a serious hazard to humans, animals and the natural environment. Currently, the nitrate pollution treatment processes developed include biological denitrification, electrodialysis, reverse osmosis, etc., with a number of defects such as secondary pollution and long reaction duration. However, nitrate is the most stable nitrogen-containing compound under aerobic environment, and is the third largest nitrogen reserve in the world. Therefore, it is an ideal route to develop a process for resource utilization based on the treatment of nitrate pollution.

As for electrocatalysis, a nitrate treatment method emerged in recent years, it is a green and efficient process with green electrons as a reducing agent. However, the current catalytic electrodes in this field are mainly expensive metal electrodes, and the selectivity and yield of the produced ammonia are relatively low.

SUMMARY

The present application aims to solve the shortcomings of the prior art, and provides a preparation method of a three-dimensional structured electric cathode based on cuprous oxide, with an application in a field of electrocatalytic reduction of nitrate, achieving high efficiency and selectivity in electrocatalytic reduction of nitrate to ammonia, with Faraday efficiency of up to 85%, a removal rate of up to 100% and selectivity of up to 99%, demonstrating a high practical application value.

In order to achieve above objectives, the present application provides following schemes:

a preparation method of a three-dimensional structured electric cathode based on cuprous oxide, including following steps:

step 1: cutting copper foam (CF), sequentially subjecting to ultrasonic treatment with acetone, hydrochloric acid, anhydrous ethanol and deionized water, followed by washing and vacuum drying to serve as an electrode substrate for later use;

step 2: dissolving sodium acetate and copper acetate in deionized water, fully stirring for completely dissolution to obtain a solution, and adjusting a pH value of the solution to be acidic to serve as an electrodeposition precursor solution; and step 3: placing the copper foam in the electrodeposition precursor solution, electrodepositing at a predetermined temperature by using a three-electrode system and a potentiostatic method, followed by taking out, washing, and drying to obtain a catalytic electrode.

Optionally, in the step 1, the copper foam is cut into a sheet of 1 centimeter (cm)*1 cm-5 cm*5 cm; a concentration of the hydrochloric acid is 0.1 molarity (M)-3 M; a duration of the ultrasonic treatment is 10 minutes (min)-30 min; and the washing is carried out with deionized water.

Optionally, in the step 2, a molar ratio of sodium acetate to copper acetate is (1-5):1; and glacial acetic acid is used to adjust the pH value of the solution to 5.7.

Optionally, in the step 3, the predetermined temperature is 20-30 degrees Celsius (° C.); a pH value is 7 after washing; and the drying is carried out under temperature of 40° C.-60° C. with a duration of 8 hours (h)-12 h.

Optionally, in the step 3, a method for electrodeposition by using the potentiostatic method includes: a deposition potential of −0.2 Volt (V)-−0.6 V, and a deposition duration of 20-120 min.

Optionally, in the step 3, a counter electrode of the three-electrode system adopts one of platinum sheet, platinum net and stone grinding rod; a reference electrode adopts one of Ag/AgCl and saturated calomel electrode; and a working electrode adopts copper foam.

Optionally, in the step 3, the catalytic electrode is a $Cu_2O$/Cu CF electric cathode, and an exposed crystal plane of the catalytic electrode is a $Cu_2O$ (111) crystal plane.

The present application also provides an application of the three-dimensional structured electric cathode based on cuprous oxide, including applying the electric cathode prepared by the method to fields of electrocatalytic reduction of nitrate and electrocatalytic ammonia production.

Compared with the prior art, the present application has the beneficial effects that:

the $Cu_2O$/Cu CF electric cathode prepared by the present application realizes efficient purification of nitrate pollutants at a lower potential, and the three-dimensional porous structure of the electric cathode ensures that the catalyst provides a better infiltration situation in the electrolyte, enabling an effective contact between the catalytic active site and the reaction intermediate, and laying the foundation for the efficient and rapid reduction of high nitrate concentrations;

the $Cu_2O/Cu$ CF electric cathode prepared by the present application has extremely high selectivity of single product, with up to 99% selectivity of ammonia product compared with similar copper-based catalysts, and low energy consumption for ammonia production, providing certain guidance for the design and preparation of electrodes for electrocatalytic ammonia synthesis process; and the $Cu_2O/Cu$ CF electric cathode prepared by the present application has good reusability and stability, and remains over 90% nitrate removal efficiency after being cycled for more than 8 times; moreover, the synthesis of the catalyst is carried out at room temperature and pressure, and is completed by one step electrodeposition only, which is simple and easy to operate and generates no pollution in the preparation process, enabling an economical, efficient and environment-friendly nitrate purification and ammonia production process.

BRIEF DESCRIPTION OF THE DRAWINGS

To illustrate the technical schemes of the present application more clearly, the drawings required for use in the embodiments are briefly described below, and it is clear that the drawings in the following description are only some embodiments of the present application, and that other drawings are available to those of ordinary skill in the art without creative labor.

DETAILED DESCRIPTION OF THE EMBODIMENTS

The technical schemes in the embodiments of the present application are described clearly and completely below in conjunction with the accompanying drawings in the embodiments of the present application, and it is clear that the described embodiments are only a part of the embodiments of the present application, not all of them. Based on the embodiments in the present application, all other embodiments obtained by a person of ordinary skill in the art without making creative labor fall within the scope of protection of the present application.

In order to make the above objectives, features and advantages of the present application more obvious and easier to understand, the present application are further described in detail with the attached drawings and specific embodiments. The reagents used in the following embodiments are all industrial pure products unless otherwise specified.

In view of the shortcomings of the prior art, the present application provides a preparation method of a three-dimensional structured electric cathode based on cuprous oxide, and the prepared non-noble metal electric cathode with efficient electrocatalytic nitrate reduction performance is used as a $Cu_2O/Cu$ CF electric cathode, which is applied to the fields of nitrate reduction and synthetic ammonia.

Figure 6:
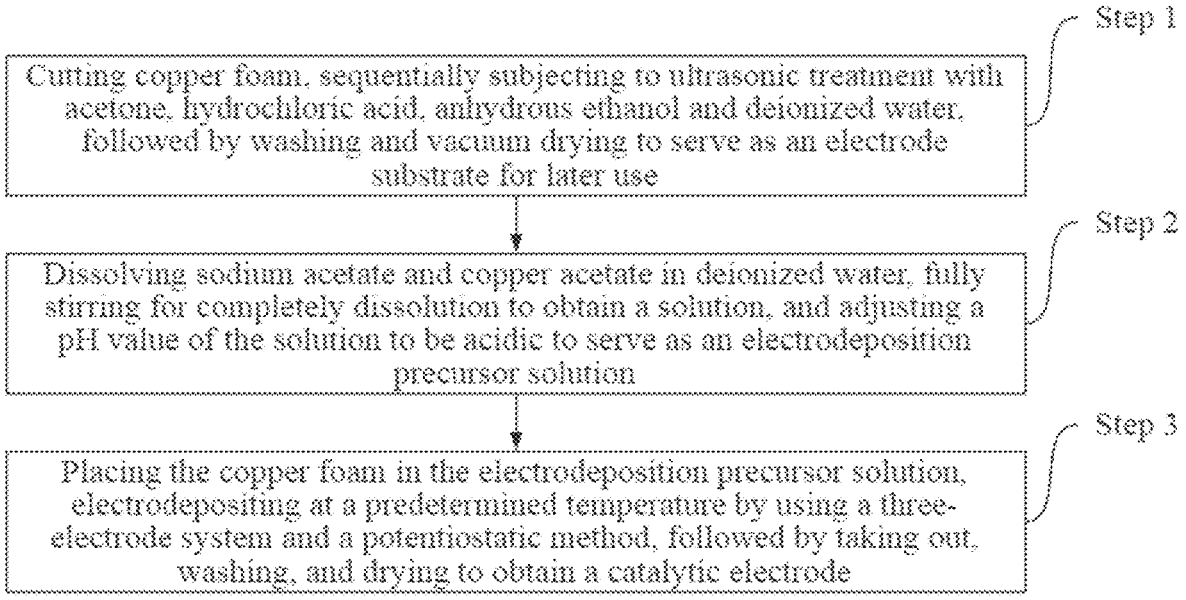
FIG. 6 shows a process of a preparation method of a three-dimensional structured electric cathode based on cuprous oxide provided by the present application.

As shown in the FIG. 6, the preparation method includes:

step 1: cutting copper foam (CF) into a thin sheet, then subjecting to ultrasonic treatment with acetone, hydrochloric acid, anhydrous ethanol and deionized water, followed by washing for several times, and vacuum drying to serve as an electrode substrate for later use;

where a size of the sheet is 1 centimeter (cm)*1 cm-5 cm*5 cm; a concentration of the hydrochloric acid is 0.1 molarity (M)-3 M; a duration of the ultrasonic treatment is 10 minutes (min)-30 min; and the washing is carried out with deionized water;

step 2: dissolving sodium acetate and copper acetate in deionized water, fully stirring for completely dissolution to obtain a solution, and adjusting a pH value of the solution to be acidic to serve as an electrodeposition precursor solution;

where a molar ratio of sodium acetate to copper acetate is (1-5):1; and glacial acetic acid is used to adjust the pH value of the solution to 5.7; and step 3: placing the copper foam in the electrodeposition precursor solution, electrodepositing at a predetermined temperature by using a three-electrode system and a potentiostatic method, followed by taking out, washing for several times, and drying to obtain a catalytic electrode.

Among them, the predetermined temperature is 20-30 degrees Celsius (° C.); a pH value is 7 after washing; and the drying is carried out under temperature of 40° C.-60° C. with a duration of 8 hours (h)-12 h. A method for electrodeposition by using the potentiostatic method includes: a deposition potential of −0.2 Volt (V)--0.6 V, and a deposition duration of 20-120 min. A counter electrode of the three-electrode system adopts one of platinum sheet, platinum net and stone grinding rod; a reference electrode adopts one of Ag/AgCl and saturated calomel electrode; and a working electrode adopts copper foam. The catalytic electrode prepared is a $Cu_2O/Cu$ CF electric cathode, and an exposed crystal plane of the catalytic electrode prepared is a $Cu_2O$ (111) crystal plane.

Embodiment 1

In the present embodiment, a molar ratio of $CH_3COONa$ to $(CH_3COO)_2Cu$ is 5:1, and a deposition duration is 60 min; and the present embodiment specifically includes the following steps:

(1) copper foam is cut into a sheet of 1 cm*1 cm, which are then ultrasonically treated with 10 milliliters (mL) acetone, 10 mL 0.1 M hydrochloric acid, 10 mL absolute ethyl alcohol and 10 mL deionized water in turn, followed by washing with deionized water for several times and vacuum drying at 40° C. for 4 h to serve as an electrode substrate for later use;

(2) sodium acetate of 0.6516 gram (g) and copper acetate of 0.3194 g are dissolved in 80 mL of deionized water, followed by stirring for completely dissolution to obtain a solution, and the pH of the solution is adjusted to 5.7 with acetic acid to serve as an electrodeposition precursor solution; and (3) the copper foam sheet is placed in the electrodeposition precursor solution obtained in step (2), and a three-electrode system is used at 25° C., with a platinum sheet as the counter electrode, the copper foam sheet as the working electrode, and Ag/AgCl as the reference electrode, and the catalytic electrode is electrodeposited at −0.2 V for 60 min using a potentiostatic method, followed by washing for several times after taken out, and drying and storing to prepare the catalytic electrode.

Figure 1:
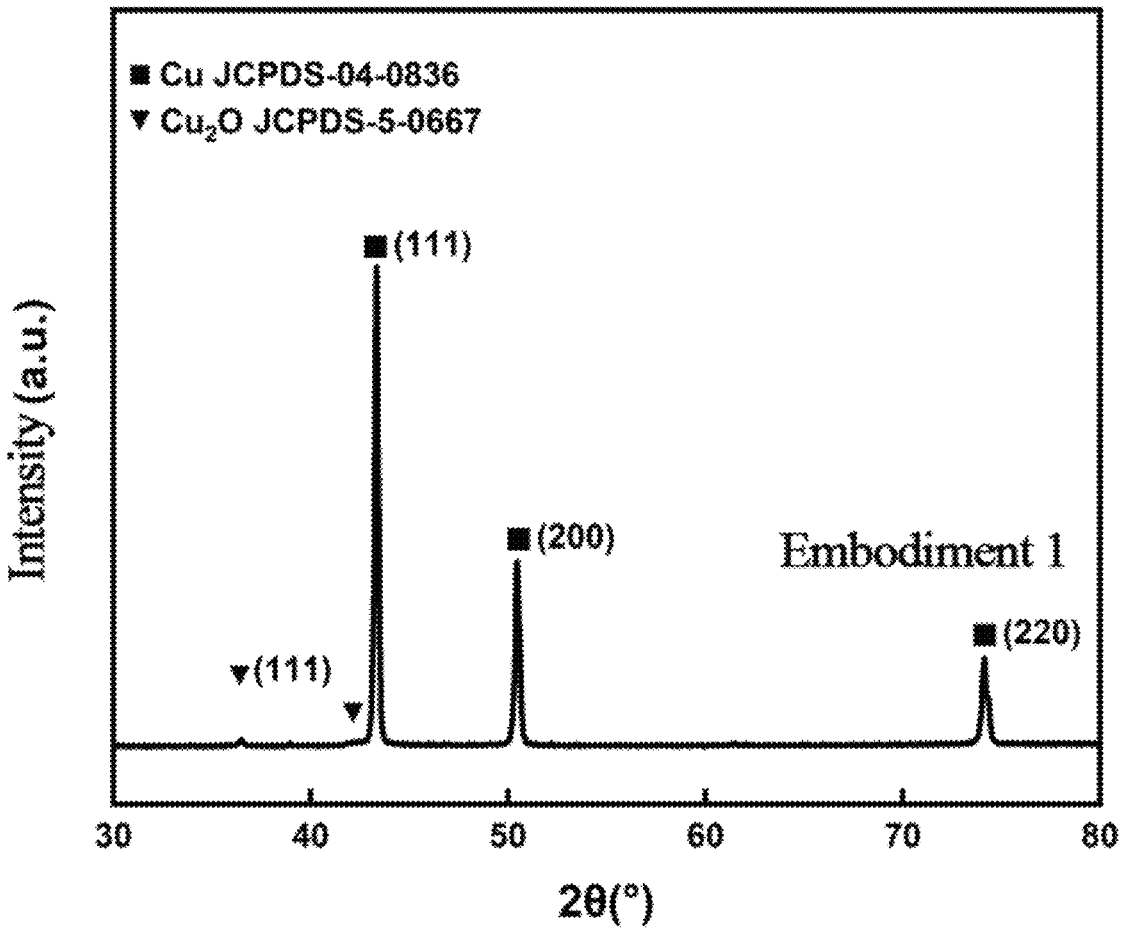
FIG. 1 is an X-ray Diffraction (XRD) pattern of $Cu_2O/Cu$ CF catalytic electrode prepared in an embodiment of the present application.
Figure 2:
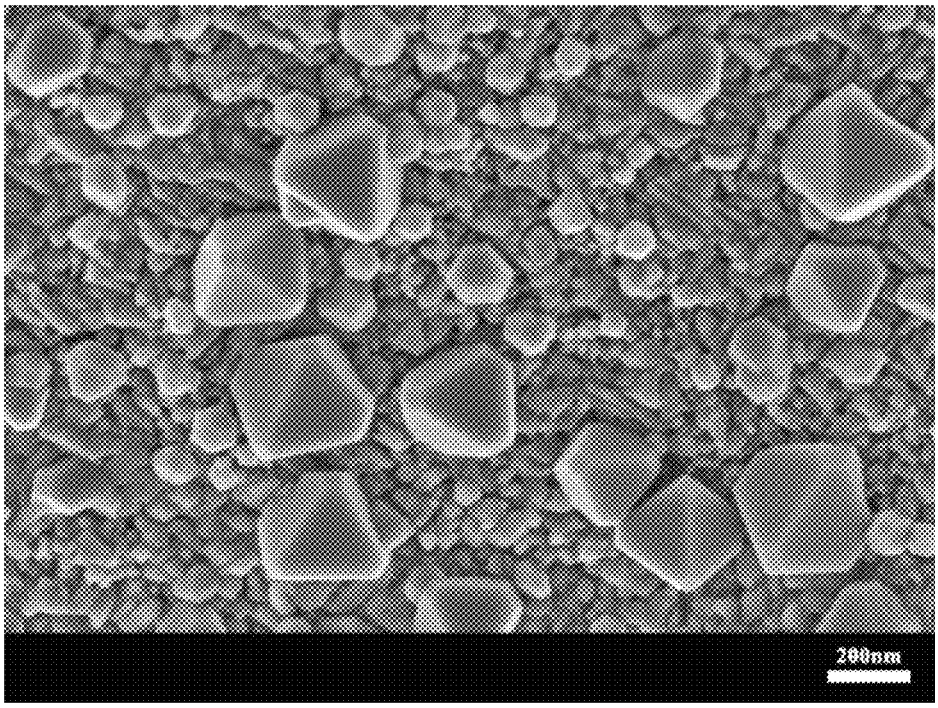
FIG. 2 is a scanning electron microscope (SEM) picture of $Cu_2O/Cu$ CF catalytic electrode prepared in an embodiment of the present application.

The products obtained in this embodiment are analyzed by X-ray diffraction, and the results are shown in FIG. 1. As can be seen form the FIG. 1, the abscissa is 2-theta (θ) diffraction angle (in degree)) (°, and the ordinate is the intensity of diffraction peak (absorbance unit, a.u.). In FIG. 1, the presence of feature peaks of Cu and $Cu_2O$ are clearly observed, demonstrating the successful synthesis of $Cu_2O$. The product obtained from this embodiment is characterized by scanning electron microscopy for the morphological structure of the composite, and the results as illustrated in FIG. 2 show that there is a regular octahedral structure, proving a successful synthesis of $Cu_2O$. Therefore, the prepared electrode is a composite material composed of $Cu_2O$ and Cu.

Embodiment 2

In this embodiment, the molar ratio of $CH_3COONa$ to $(CH_3COO)_2Cu$ is 5:1, the deposition duration is 40 min, and the present embodiment specifically includes the following steps:

(1) copper foam is cut into a sheet of 1 cm*1 cm, which are then ultrasonically treated with 10 mL acetone, 10 mL 0.1 M hydrochloric acid, 10 mL absolute ethyl alcohol and 10 mL deionized water in turn, followed by washing with deionized water for several times and vacuum drying at 40° C. for 4 h to serve as an electrode substrate for later use;

(2) sodium acetate of 0.6516 g and copper acetate of 0.3194 g are dissolved in 80 mL of deionized water, followed by stirring for completely dissolution of the salt to obtain a solution, and the pH of the solution is adjusted to 5.7 with acetic acid to serve as an electrodeposition precursor solution; and (3) the copper foam sheet is placed in the electrodeposition precursor solution obtained in the step (2), and a three-electrode system is used at 25° C., with a platinum sheet as the counter electrode, the copper foam sheet as the working electrode, and Ag/AgCl as the reference electrode, and the catalytic electrode is electrodeposited at −0.2 V for 40 min using a potentiostatic method, followed by washing for several times after taken out, and drying and storing to prepare the catalytic electrode.

Embodiment 3

The molar ratio of $CH_3COONa$ to $(CH_3COO)_2Cu$ of the present embodiment is 5:1, with a deposition duration of 20 min, and the present embodiment specifically includes the following steps:

(1) copper foam is cut into a sheet of 1 cm*1 cm, which are then ultrasonically treated with 10 mL acetone, 10 mL 0.1 M hydrochloric acid, 10 mL absolute ethyl alcohol and 10 mL deionized water in turn, followed by washing with deionized water for several times and vacuum drying at 40° C. for 4 h to serve as an electrode substrate for later use;

(2) sodium acetate of 0.6516 g and copper acetate of 0.3194 g are dissolved in 80 mL of deionized water, followed by stirring for completely dissolution of the salt to obtain a solution, and the pH of the solution is adjusted to 5.7 with acetic acid to serve as an electrodeposition precursor solution; and (3) the copper foam sheet is placed in the electrodeposition precursor solution obtained in step (2), and a three-electrode system is used at 25° C., with a platinum sheet as the counter electrode, the copper foam sheet as the working electrode, and Ag/AgCl as the reference electrode, and the catalytic electrode is electrodeposited at −0.2 V for 20 min using a potentiostatic method, followed by washing for several times after taken out, and drying and storing to prepare the catalytic electrode.

Embodiment 4

The molar ratio of $CH_3COONa$ to $(CH_3COO)_2Cu$ of the present embodiment is 5:1, with a deposition duration of 60 min, and the present embodiment specifically includes the following steps:

(1) copper foam is cut into a sheet of 1 cm*1 cm, which are then ultrasonically treated with 10 mL acetone, 10 mL 0.1 M hydrochloric acid, 10 mL absolute ethyl alcohol and 10 mL deionized water in turn, followed by washing with deionized water for several times and vacuum drying at 40° C. for 4 h to serve as an electrode substrate for later use;

(2) sodium acetate of 0.6516 g and copper acetate of 0.3194 g are dissolved in 80 mL of deionized water, followed by stirring for completely dissolution of the salt to obtain a solution, and the pH of the solution is adjusted to 5.7 with acetic acid to serve as an electrodeposition precursor solution; and (3) the copper foam sheet is placed in the electrodeposition precursor solution obtained in step (2), and a three-electrode system is used at 25° C., with a platinum sheet as the counter electrode, the copper foam sheet as the working electrode, and Ag/AgCl as the reference electrode, and the catalytic electrode is electrodeposited at −0.6 V for 60 min using a potentiostatic method, followed by washing for several times after taken out, and drying and storing to prepare the catalytic electrode.

Embodiment 5

In this embodiment, the catalytic electrodes obtained from Embodiments 1 to 4 are used for electrocatalytic reduction of nitrate experiments as follows.

Experimental conditions: the electrocatalytic reduction of nitrate experiments are carried out using an electrochemical workstation (Chenhua 760E). The tests are performed using a three-electrode system with a 1 cm*1 cm platinum sheet as the counter electrode, the catalytic electrodes obtained from Embodiments 1-4 as the working electrodes, and the reference electrodes with Ag/AgCl reference electrodes. The experiments are conducted in an H-type electrolyzer with the cathode and anode chambers separated by a Nafion117 membrane. The molar concentrations of sulfate and nitrate (as nitrogen) are 0.5 M and 0.01 M, respectively. 3.55 g of anhydrous sodium sulfate (superior pure) and 0.051 g of potassium nitrate (superior pure) are dissolved in 50 mL of deionized water as the electrolyte in the cathode chamber. Before the test, argon gas is introduced into the electrolyte for 30 min to ensure the anaerobic environment of the electrolyte to exclude the interference of oxygen with the reaction process.

Electrochemical testing process: the relationship between potential and current density within a set potential window is recorded using linear sweep voltammetry (LSV) to investigate the electrochemical activity of the material over a range of voltages. The change curve of current with time at the set potential is recorded using the chronoamperometry method (i-t curve), and the Faraday efficiency at that voltage is calculated by integrating the charge; the concentrations of nitrate, nitrite and ammonia nitrogen after the reaction are measured using a UV spectrophotometer to investigate the distribution of changes in total nitrogen. The present embodiment uses 0V--1.6V (vs Ag/AgCl) as the potential window for LSV scanning, with the scanning rate set to 100 mV/s; the distribution of product nitrogen species at five points of −1.0 V, −1.1 V, −1.2 V, −1.3 V, −1.4 V is measured and the Faraday efficiency is calculated.

Table 1 shows the removal efficiency of the catalytic electrodes prepared in Embodiments 1-4 for the electrocatalytic reduction of nitrate for ammonia synthesis under experimental conditions at −1.2 V (vs. Ag/AgCl) applied potential and the comparison of ammonia yields.

TABLE 1

| Items | $NO^{3-}$ removal rate | Synthetic ammonia yield |
|---|---|---|
| $Cu_2O$/Cu CF (−0.2 V 60 min) | 99.93% | 0.3074 mmol $h^{-1}$ $cm^{-2}$ |
| $Cu_2O$/Cu CF (−0.2 V 40 min) | 97.71% | 0.2228 mmol $h^{-1}$ $cm^{-2}$ |
| $Cu_2O$/Cu CF (−0.2 V 20 min) | 86.68% | 0.1181 mmol $h^{-1}$ $cm^{-2}$ |
| $Cu_2O$/Cu CF (−0.6 V 60 min) | 89.21% | 0.2358 mmol $h^{-1}$ $cm^{-2}$ |

It can be seen from Table 1 that when the deposition potential is set to −0.2 V, the removal rate of nitrate is above 85% when it is deposited for 20 min, while when the deposition potential is set to −0.6 V, the performance of the electrode prepared for 60 min is close to the above-mentioned electrode. Considering the energy consumption factor, −0.2 V as the deposition potential and 60 min as the deposition duration are selected as the most suitable preparation conditions. This is attributed to the fact that the electrodeposition potential and electrodeposition duration are related to the morphology and exposed crystal planes of the deposits, and −0.2 V as the deposition potential enables more exposure of $Cu_2O$ (111) crystal plane, which has a facilitating effect on the selective reduction of nitrate to ammonia.

Embodiment 6

In this embodiment, pure copper foam is used for the electrocatalytic reduction of nitrate to synthesize ammonia, with process as follows:

The copper foam electrode substrate obtained in Embodiment 1 after removing the surface organic matter only in the step (1) is used as a comparison on electrode to determine the relevant electrochemical properties as well as the nitrate reduction performance.

Experimental conditions: the electrocatalytic reduction of nitrate experiments are carried out using an electrochemical workstation (Chenhua 760E). The tests are performed using a three-electrode system with a 1 cm*1 cm platinum sheet as the counter electrode, the pure copper foam as the working electrodes, and the reference electrodes with Ag/AgCl reference electrodes. The experiments are conducted in an H-type electrolyzer with the cathode and anode chambers separated by a Nafion117 membrane. The concentrations of sulfate and nitrate (as nitrogen) are 0.5 M and 0.01 M, respectively. 3.55 g of anhydrous sodium sulfate (superior pure) and 0.05 g of potassium nitrate are dissolved in 50 mL of deionized water as the electrolyte in the cathode chamber. Before the test, argon gas is introduced into the electrolyte for 30 min to ensure the anaerobic environment of the electrolyte to exclude the interference of oxygen with the reaction process.

In the electrochemical test process, the change curve of current with time at the set potential is recorded using the chronoamperometry method (i-t), and the Faraday efficiency at that voltage is calculated by integrating the charge; the concentrations of nitrate, nitrite and ammonia nitrogen after the reaction are measured using a UV spectrophotometer to investigate the change and distribution of total nitrogen.

From the above embodiments, it can be concluded that the $Cu_2O$/Cu CF electric cathode prepared by the preparation method of the present application achieves efficient purification of nitrate pollutants at a lower potential, and the electric cathode has a high single product selectivity of 99% compared with similar copper-based catalysts, and low energy consumption for ammonia production; moreover, the electric cathode has good reusability and stability, with more than 90% nitrate removal rate after 8 cycles. The synthesis of the catalyst is conducted at room temperature and pressure, and is completed by one-step electrodeposition, with advantages of simple and easy preparation process, no pollution, etc., enabling the purification of nitrate and ammonia production in an economical, efficient and environmentally friendly way.

Figure 3:
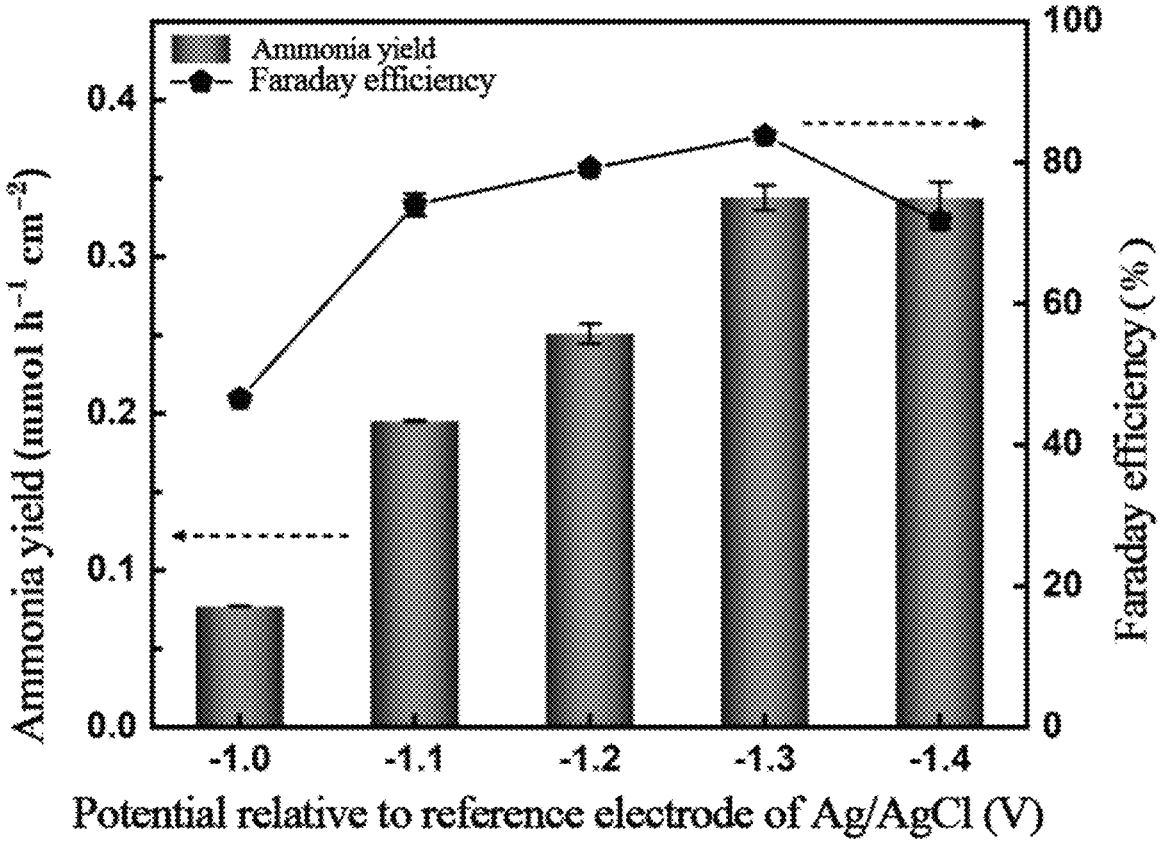
FIG. 3 is a comparative diagram of Faraday efficiency and ammonia yield of ammonia production by electrocatalytic reduction of nitrate in an embodiment of the present application at different applied potentials.

As shown in FIG. 3, the Faraday efficiency and ammonia yield performance of the $Cu_2O$/Cu catalytic electrode prepared in Embodiment 1 for ammonia synthesis by electrocatalytic reduction of nitrate are shown in FIG. 3. It can be seen from the FIG. 3 that in an electrolyte containing 100 mg/L $NO_3^-N$, the Faraday efficiency of the electrode prepared in Embodiment 1 of the present application is up to 85% and the ammonia yield is up to 0.357 mmol $h^{-1}$ $cm^{-2}$.

Figure 4:
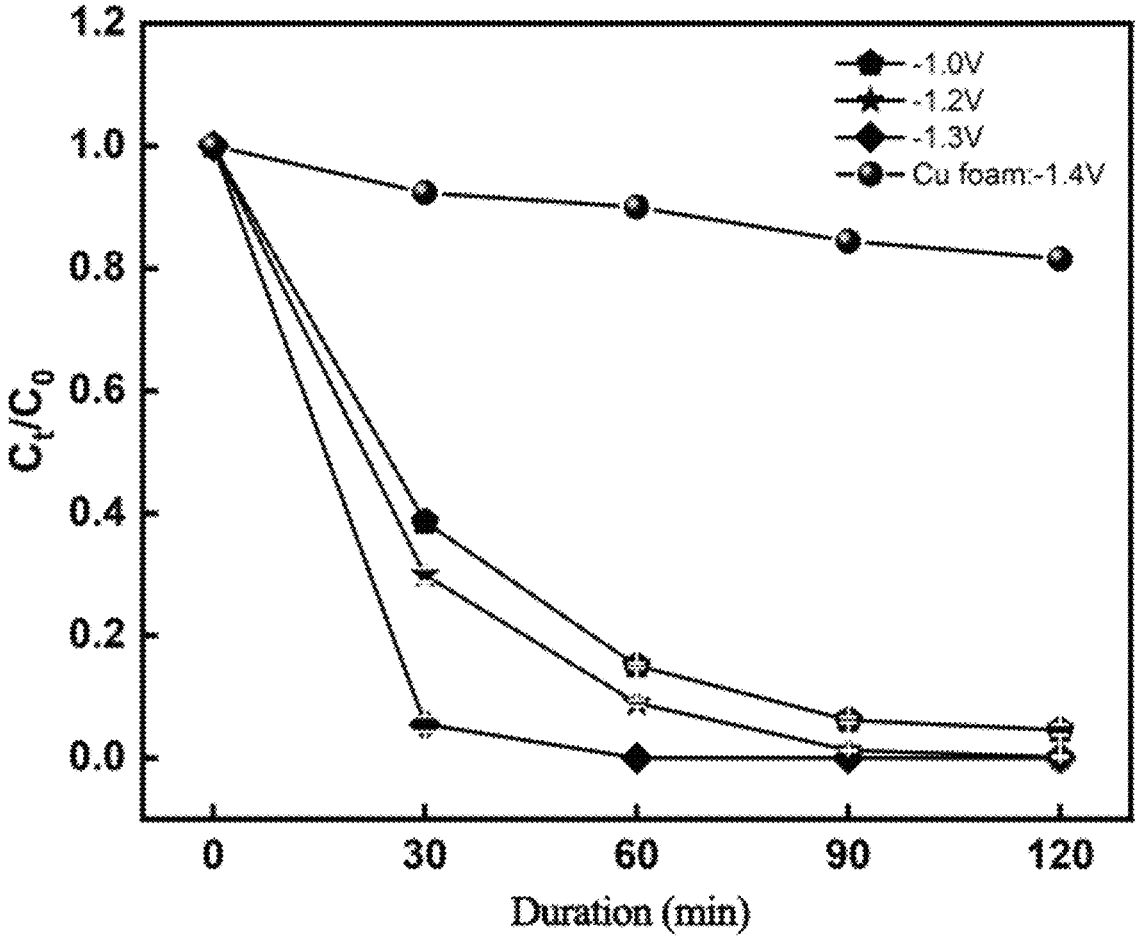
FIG. 4 is a comparative diagram of nitrate concentration changing with time under different applied potentials and a blank comparison diagram of pure copper foam (CF).

The curve of nitrate content ratio varies with time during ammonia synthesis by electrocatalytic reduction of nitrate at the $Cu_2O$/Cu catalytic electrode prepared in Embodiment 1 is shown in FIG. 4. It can be seen that as the voltage gradually increases to −1.3 V (vs. Ag/AgCl), the removal rate of nitrate gradually increases in the first 30 min, and the nitrate is basically completely removed within 30 min at −1.3 V. In contrast, the pure copper foam in Embodiment 6 shows very little nitrate removal at an applied potential of −1.4 V (vs. Ag/AgCl).

Figure 5:
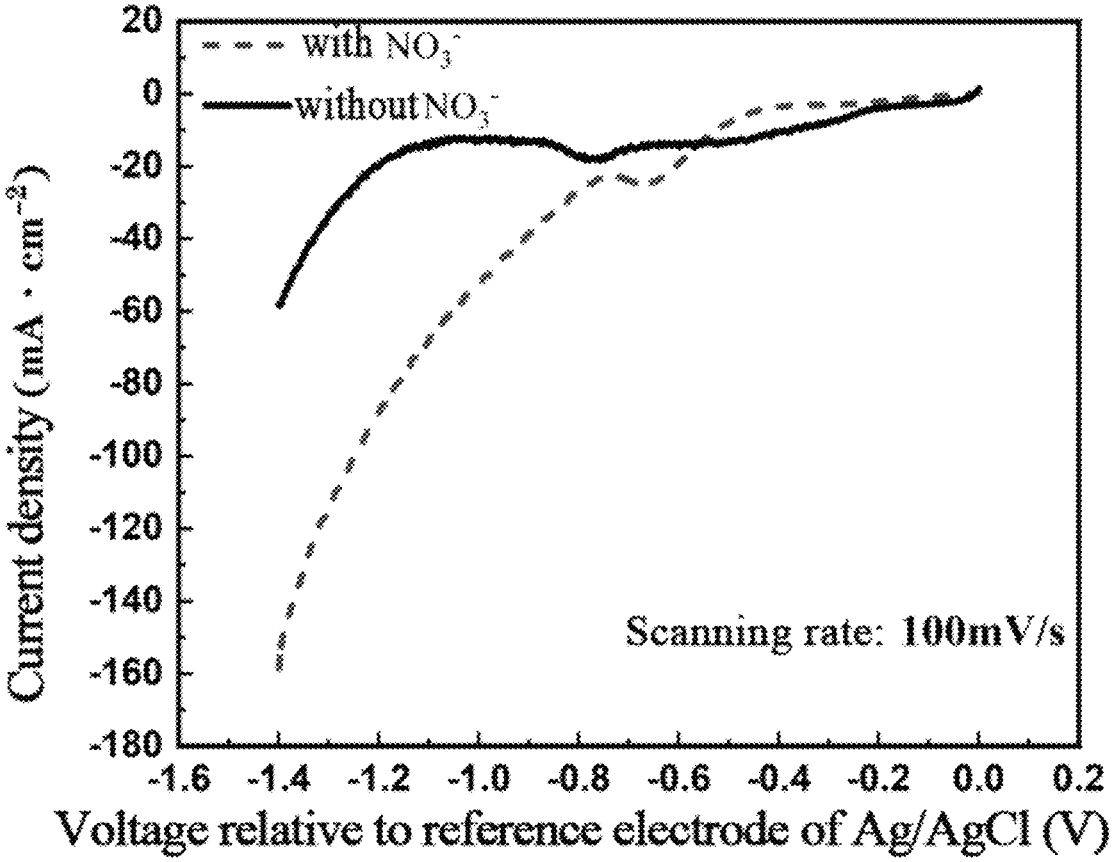
FIG. 5 shows linear sweep voltammetry (LSV) curves of $Cu_2O/Cu$ CF catalytic electrode prepared in an embodiment of the present application with or without nitrate.

FIG. 5 shows the LSV curve of the $Cu_2O$/Cu catalytic electrode prepared in Embodiment 1 at a potential window from 0 V to −1.6 V (vs. Ag/AgCl) with a scanning rate of 100 mV/s. It can be seen that the current density increases rapidly after the addition of nitrate to the electrolyte, and thus it is concluded that the prepared electric cathode has an excellent effect on nitrate reduction.

The above described embodiments represent only a description of the preferred way of the present application, not a limitation of the scope of the present application. Without departing from the spirit of the design of the present application, all kinds of deformations and improvements made to the technical schemes of the present application by a person of ordinary skill in the art shall fall within the scope of protection determined by the claims of the present application.

What is claimed is:

1. A preparation method of a three-dimensional structured electric cathode based on cuprous oxide for reduction of nitrate and electrocatalytic ammonia production, comprising the following steps:

step 1: cutting copper foam (CF), sequentially subjecting to ultrasonic treatment with acetone, hydrochloric acid, anhydrous ethanol and deionized water, followed by washing and vacuum drying to serve as an electrode substrate for later use;

step 2: dissolving sodium acetate and copper acetate in deionized water, fully stirring for completely dissolution to obtain a solution, and adjusting a pH value of the solution to be acidic to serve as an electrodeposition precursor solution;

step 3: placing the copper foam in the electrodeposition precursor solution, electrodepositing at a predetermined temperature by using a platinum sheet as a counter electrode, an Ag/AgCl as a reference electrode and a working electrode adopts the copper foam, and a potentiostatic method comprises: a deposition potential of −0.2 Volt--0.6 Volt, and a deposition duration of 20-120 minutes, followed by taking out, washing, and drying to obtain a $Cu_2O$/Cu CF catalytic electrode, and an exposed crystal plane of the catalytic electrode is a $Cu_2O$ (111) crystal plane; and step 4: the catalytic electrode obtained from steps 1-3 is immersed in an electrolyte composed of 3.55 g of anhydrous sodium sulfate and 0.051 g of potassium nitrate dissolved in 50 mL of deionized water, with argon gas introduced into the electrolyte for 30 minutes to ensure an anaerobic environment and eliminate oxygen interference during a subsequent reaction process, followed by recording the relationship between potential and current density using linear sweep voltammetry (LSV) within a set potential window to investigate an electrochemical activity of a material for the reduction of nitrate and electrocatalytic ammonia production.

2. The preparation method of the three-dimensional structured electric cathode based on cuprous oxide according to claim 1, wherein in the step 1, the copper foam is cut into a sheet of 1 centimeter×1 centimeter-5 centimeters×5 centimeters; a concentration of the hydrochloric acid is 0.1 molarity-3 molarity; a duration of the ultrasonic treatment is 10 minutes-30 minutes; and the washing is carried out with deionized water.

3. The preparation method of the three-dimensional structured electric cathode based on cuprous oxide according to claim 1, wherein in the step 2, a molar ratio of sodium acetate to copper acetate is (1-5): 1; and glacial acetic acid is used to adjust the pH value of the solution to 5.7.

4. The preparation method of the three-dimensional structured electric cathode based on cuprous oxide according to claim 1, wherein in the step 3, the predetermined temperature is 20-30 degrees Celsius; a pH value is 7 after washing; and the drying is carried out under temperature of 40 degrees Celsius-60 degrees Celsius with a duration of 8 hours-12 hours.

* * * * *